US010895129B2

(12) United States Patent
Linklater et al.

(10) Patent No.: US 10,895,129 B2
(45) Date of Patent: Jan. 19, 2021

(54) OPEN HOLE DRILLING MAGNET

(71) Applicant: M-I DRILLING FLUIDS UK LTD, Aberdeen (GB)

(72) Inventors: James Linklater, Buckie (GB); James Edward Atkins, Aberdeen (GB); George Telfer, Aberdeen (GB)

(73) Assignee: M-I DRILLING FLUIDS UK LTD, Aberdeen (GB)

( * ) Notice: Subject to any disclaimer, the term of this patent is extended or adjusted under 35 U.S.C. 154(b) by 128 days.

(21) Appl. No.: 15/513,986

(22) PCT Filed: Sep. 23, 2015

(86) PCT No.: PCT/US2015/051587
§ 371 (c)(1),
(2) Date: Mar. 23, 2017

(87) PCT Pub. No.: WO2016/049108
PCT Pub. Date: Mar. 31, 2016

(65) Prior Publication Data

US 2017/0247980 A1 Aug. 31, 2017

Related U.S. Application Data

(60) Provisional application No. 62/054,715, filed on Sep. 24, 2014.

(51) Int. Cl.
*E21B 37/00* (2006.01)
*E21B 27/00* (2006.01)

(52) U.S. Cl.
CPC ..... *E21B 37/00* (2013.01); *E21B 27/00* (2013.01)

(58) Field of Classification Search
CPC ..... E21B 37/00; E21B 31/06; E21B 17/10
See application file for complete search history.

(56) References Cited

U.S. PATENT DOCUMENTS 3,637,033 A 1/1972 Mayall
5,921,591 A * 7/1999 Argent ..... E21B 17/0426 228/135

(Continued)

FOREIGN PATENT DOCUMENTS

WO 2014/013250 A2 1/2014

OTHER PUBLICATIONS

International Preliminary Report on Patentability for PCT/US2015/051587 dated Apr. 6, 2017.

(Continued)

*Primary Examiner* — Robert E Fuller
*Assistant Examiner* — Theodore N Yao

(57) ABSTRACT

Apparatus, and methods of use, where the apparatus includes a cylindrical tool main body defining an axial centerline, the main body having a first bladed magnet section having at least one blade extending substantially perpendicular from the axial centerline at a first angle, a second bladed magnet section having at least one blade extending substantially perpendicular from the axial centerline at a second angle, and a hardfaced cylindrical section disposed between the first bladed magnet section and the second bladed magnet section, wherein the outer circumference of the hardfaced cylindrical section defines the outer circumference of the tool main body.

26 Claims, 10 Drawing Sheets

(56) References Cited

U.S. PATENT DOCUMENTS

| | | | | |
|---|---|---|---|---|
| 2001/0013413 | A1* | 8/2001 | Ruttley | E21B 31/06 166/301 |
| 2006/0011346 | A1 | 1/2006 | Theriot, Sr. | |
| 2008/0202756 | A1* | 8/2008 | Borst | E21B 31/06 166/304 |
| 2010/0038408 | A1* | 2/2010 | Keshavan | B23K 20/1275 228/112.1 |
| 2011/0048803 | A1* | 3/2011 | Robson | E21B 17/10 175/57 |
| 2011/0168404 | A1* | 7/2011 | Telfer | E21B 31/06 166/378 |
| 2011/0284203 | A1 | 11/2011 | Hern et al. | |
| 2014/0096972 | A1* | 4/2014 | Leiper | E21B 37/00 166/311 |
| 2015/0122480 | A1* | 5/2015 | Sullivan | E21B 31/06 166/66.5 |
| 2015/0192000 | A1* | 7/2015 | Cooper | E21B 31/06 166/311 |

OTHER PUBLICATIONS

Office Action for the equivalent Canadian paten application 2962416 dated Jan. 17, 2018.

P.A. Amundsen, et al., "Magnetic Shielding During MWD Azimuth Measurements and Wellbore Positioning," SPE Drilling & Completion, Jun. 2010, pp. 219-222.

E. Nymes, et al., "Error Properties of Magnetic Directional Surveying Data," SPWLA 46th Annual Logging Symposium, Jun. 26-29, 2005, pp. 1-16.

T. Torkildsen, et al., "Drilling Fluid affects MWD Magnetic Azimuth and Wellbore Position," SPE Drilling Conference, Dallas, Texas, USA Mar. 2-4, 2004, pp. 1-8.

H. Wilson, "Wellbore Position Errors Caused by Drilling Fluid Contamination," SPE Annual Technical Conference and Exhibition, New Orleans, Louisiana, Sep. 30-Oct. 3, 2001, pp. 1-8.

Examination Report for the counterpart UK patent application 1704305.0 dated May 27, 2020.

* cited by examiner

OPEN HOLE DRILLING MAGNET

CROSS-REFERENCE TO RELATED APPLICATIONS

The present application is a 371 national stage entry of International Patent Application Serial No. PCT/US2015/051587 filed on Mar. 31, 2016, which document is based on and claims priority to U.S. Provisional Application Ser. No. 62/054,715, filed Sep. 24, 2014, which provisional application is incorporated herein by reference in its entirety.

BACKGROUND

The statements in this section merely provide background information related to the present disclosure and may not constitute prior art.

Various drilling and cleaning operations in the oil and gas industry create debris that becomes trapped in a wellbore, including ferromagnetic debris. Debris management is an important consideration when drilling, completing and producing a well. Unwanted debris can be responsible for many problems and unforeseen costs, particularly in highly deviated holes, extreme water depths, and extended reach applications. This debris may be generated from a number of sources, including formation cuttings, mud solids, milling, shoe track drill outs, cementing, gun debris and ferrous residuals from casing wear. When debris is in a wellbore, it can damage drillstring components, workstring equipment and complex completion devices, as well as increase the risk that a well will never achieve its full production potential.

In drilling operations, a number of concerns may be presented as a result of unwanted debris in the wellbore. For example, a reduction and/or loss of rate of penetration (ROP) can often be due to a worn/damaged bit. The contribution which the presence of ferrous debris has on ROP loss is often an unknown unless there is definitive visual evidence of the mode of damage. Even when there is evidence of conventional wear, due to the nature of bit wear/erosion this can subsequently destroy any evidence of mechanical damage which happened previously.

In some other cases, the drillstring may be caught in the wellbore in a condition termed "stuck pipe", where debris falls into the wellbore or breaks off downhole equipment and jams the drillstring. The debris in the wellbore generally occurs because of poor housekeeping on the rig floor, the wellbore cover not being installed, human error or inattention, or downhole equipment failure.

Another event which may occur as a result of debris in the wellbore is string stall, which is related to relative string rotation being prevented. There are a number of different mechanisms which can cause the string to stall, one of which being caused by debris in the wellbore which can jam the O/D of the string against the hole wall. String stall is a dangerous action since it may cause downhole connection makeup and/or connection backoff depending on the location of the stall point, as it causes additional makeup above the stall point and reactive torque below the stall point.

In yet other cases, bottom hole assembly (BHA) mechanical equipment damage can occur as the drillstring rotates at high RPM, when there is metallic debris present in the wellbore.

Methods have been used to circulate fluids up the annulus at a rapid rate and thereby carry debris upward, with expectations that the debris will then settle into the basket for retrieval when circulation is reduced. Some basket tools utilize a venturi action to draw debris into the tool. Other tools utilize magnets mounted within a housing for being lowered into the well. Some tools may practically be limited to retrieving cuttings since magnetization is only at the bottom of the tool. Yet other tools utilize a plurality of magnets aligned in cavities near the outer surface of the tool. Each magnet may be recessed in the tool body. Exposed magnets are subject to physical damage during the process of cleaning debris from the well. Conventional metal debris retrieving tools are relatively expensive, and it is difficult or impossible to effectively clean and change out the magnets of most tools in the field. While these magnetic tools have been developed for the removal of ferromagnetic metallic debris from a wellbore, they are most often designed and utilized for removing debris from a cased section of the wellbore.

Thus, there is a continuing need for improved magnetic wellbore cleaning tools and methods involving the use of such tools, which address the above described problems, and such need met at least in part by the invention described in the following disclosure.

SUMMARY

This section provides a general summary of the disclosure, and is not a necessarily a comprehensive disclosure of its full scope or all of its features.

In a first aspect of the disclosure, an apparatus is provided which includes a cylindrical tool main body defining an axial centerline, the main body having a first bladed magnet section having at least one blade extending substantially perpendicular from the axial centerline at a first angle, a second bladed magnet section having at least one blade extending substantially perpendicular from the axial centerline at a second angle, and a hardfaced cylindrical section disposed between the first bladed magnet section and the second bladed magnet section, where the outer circumference of the hardfaced cylindrical section defines the outer circumference of the tool main body. The apparatus may further include an upper end configured for suspending the tool main body. In some cases, the apparatus may further include a third bladed magnet section having at least one blade extending substantially perpendicular from the axial centerline at a third angle, and a second hardfaced cylindrical section disposed between the second bladed magnet section and the third bladed magnet section. In some other cases, the apparatus may further have a fourth bladed magnet section having at least one blade extending substantially perpendicular from the axial centerline at a fourth angle, and a third hardfaced cylindrical section disposed between the third bladed magnet section and the fourth bladed magnet section. The bladed magnet sections may include slots therein for receiving and securing magnets. Further, the hardfaced cylindrical section may have a smooth continuous circumferential outer surface. In some embodiments, the hardfaced cylindrical section has an outer circumference which is greater than the circumference of the bladed magnet sections.

Another aspect of the disclosure includes a cleaning tool for use in cleaning ferrous material from an open-hole wellbore, the cleaning tool having a first bladed magnet section defining a first circumference, a second bladed magnet section defining a second circumference, and a hardfaced cylindrical section defining a third circumference. The hardfaced cylindrical section may be disposed between the first bladed magnet section and the second bladed magnet section, and the third circumference may be greater than or equal to the first circumference and the second circumference. The cleaning tool may further include a third bladed magnet section defining a fourth circumference and a second hardfaced cylindrical section disposed between the second bladed magnet section and the third bladed magnet section, where the third circumference is greater than or equal to the first circumference, the second circumference and the fourth circumference. In another aspect, the cleaning tool has a fourth bladed magnet section defining a fifth circumference and a third hardfaced cylindrical section disposed between the third bladed magnet section and the fourth bladed magnet section, where the third circumference is greater than or equal to the first circumference, the second circumference, the fourth circumference and the fifth circumference. In some cases, the bladed magnet sections each have four blades extending substantially perpendicular from an axial centerline of the cleaning tool. The bladed magnet sections may contain slots therein for receiving and securing magnets, and in some embodiments, each blade has four slots. The hardfaced cylindrical section may be a smooth continuous circumferential outer surface.

Another aspect of the disclosure is cleaning tool for use in cleaning ferrous material from an open-hole wellbore, which includes a first bladed magnet section defining a first circumference and at least one hardfaced cylindrical section defining a second circumference, where the hardfaced cylindrical section is disposed adjacent the bladed magnet section. The first bladed magnet section may include at least one slot having opposing chamfer flanged edges, at least one magnet disposed within the slot, and a retainer system for securing the magnet within the slot. The tool may have a second bladed magnet section defining a third circumference where the second circumference is greater than or equal to the first circumference and the third circumference, and where the hardfaced cylindrical section is disposed between the first bladed magnet section and the second bladed magnet section. In some cases, the retainer system includes one or more of a bolt, a rotary detent, a lock washer, and a circlip, while in other cases the retainer system has a retainer pin and a swage ring.

In yet another aspect of the disclosure, a method is provided for retrieving ferrous metal debris from an open-hole wellbore. The method generally includes attaching to a work string an apparatus having a first bladed magnet section, a second bladed magnet section, and a hardfaced cylindrical section disposed between the first bladed magnet section and the second bladed magnet section. The apparatus is then run the into an open-hole section of a wellbore, ferrous metal debris is attracted to and retained in any of the bladed magnet sections, and then the apparatus is removed from the wellbore in order to remove the ferrous metal debris. In some instances the apparatus further includes a third bladed magnet section and a second hardfaced cylindrical section disposed between the second bladed magnet section and the third bladed magnet section. The apparatus used in the method may further include a fourth bladed magnet section and a third hardfaced cylindrical section disposed between the third bladed magnet section and the fourth bladed magnet section. The bladed magnet sections may have blades extending substantially perpendicular from an axial centerline of the apparatus, and in some embodiments, each bladed magnet section has four blades. The blades may have slots therein for receiving and securing magnets, and in some instances, contain four slots. The hardfaced cylindrical section may be a smooth continuous circumferential outer surface. Also, the hardfaced cylindrical section may have outer circumference greater than the circumference of the bladed magnet sections.

DRAWINGS

The drawings described herein are for illustrative purposes only of selected embodiments and not all possible implementations, and the drawings are not intended to limit the scope of the disclosure.

Figure 3A:
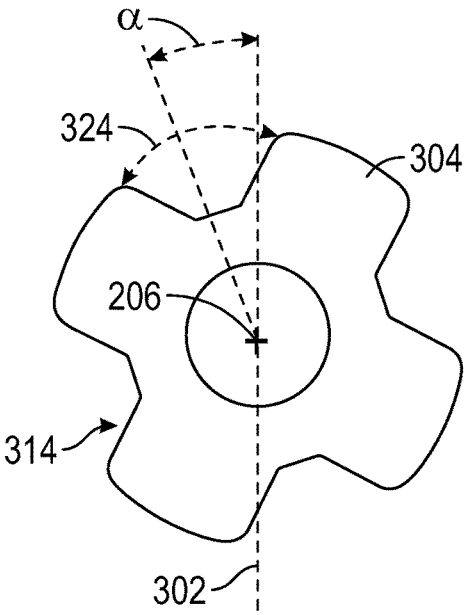
Figure 3B:
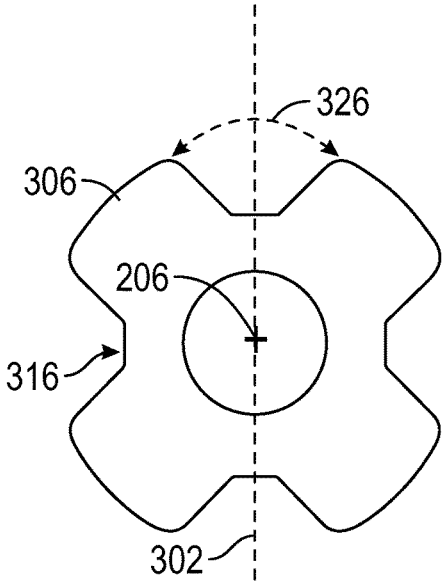
Figure 3C:
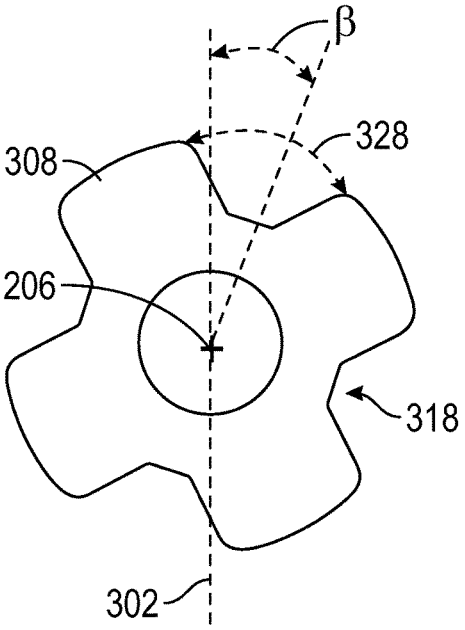

FIGS. 3*a*, 3*b* and 3*c* together in a cross section view illustrate improved circumferential coverage of a plurality of magnet pocket areas of a magnetic tool apparatus, in accordance with an aspect of the disclosure.

Figure 4A:
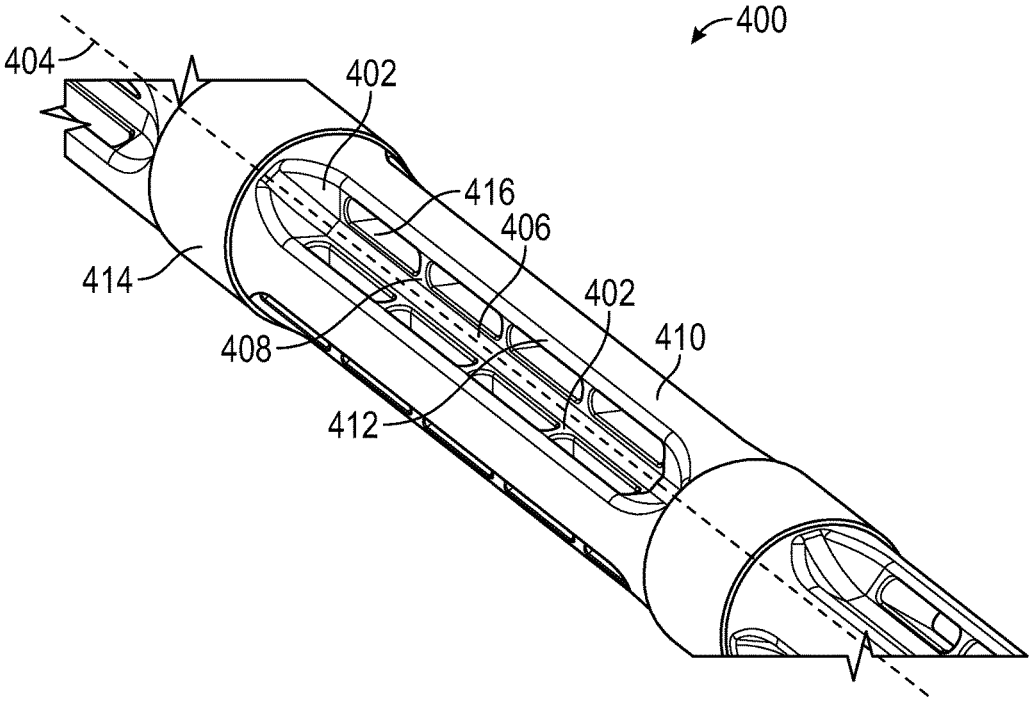
Figure 4B:
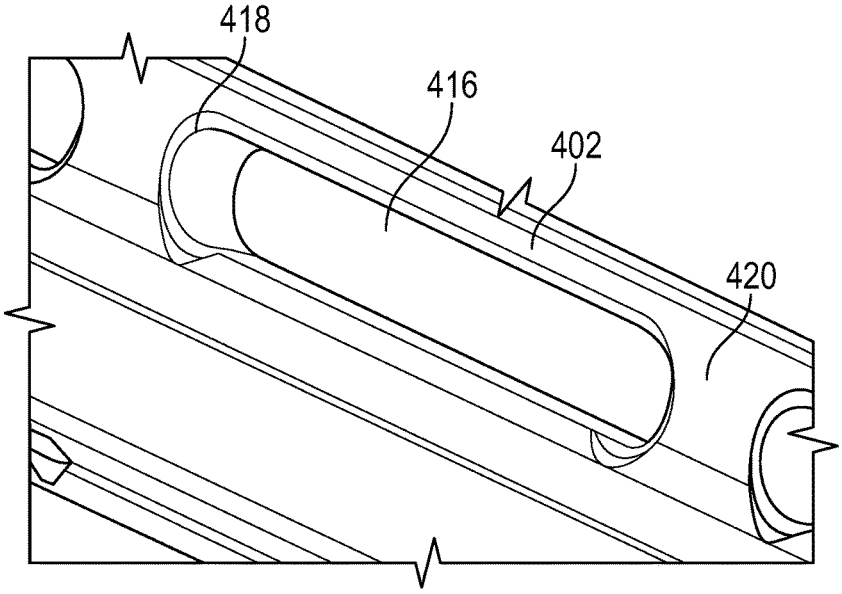
Figure 4C:
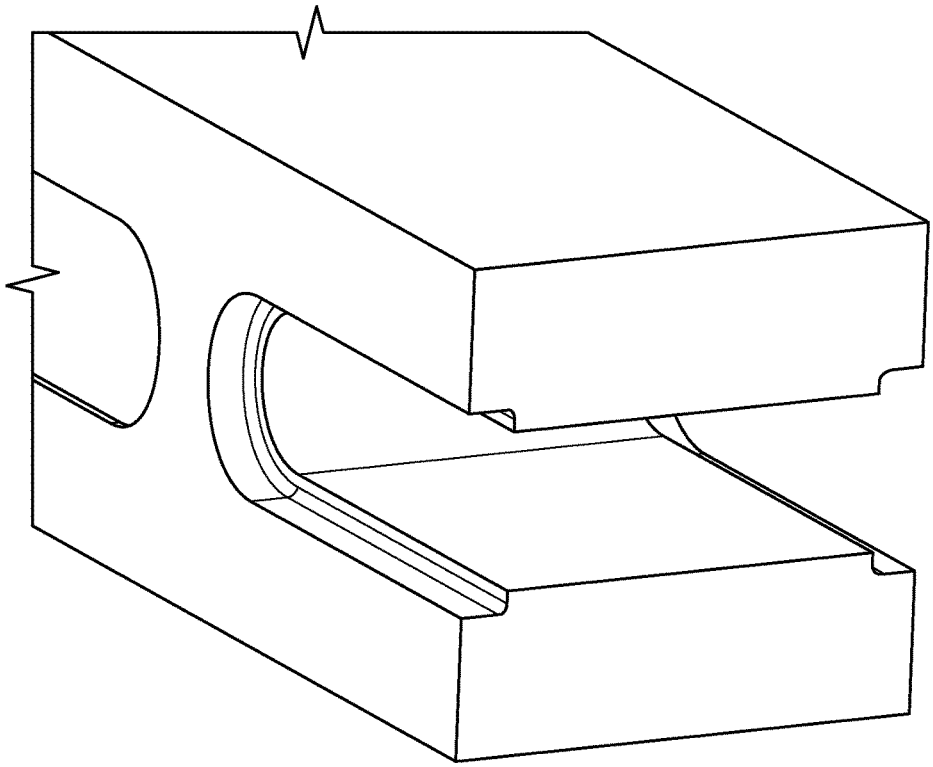

FIGS. 4*a*, 4*b* and 4*c* depict in a perspective view blade details of one magnetic tool apparatus in accordance with an aspect of the disclosure.

FIGS. 5*a*, 5*b*, 5*c*, 5*d*, 5*e* and 5*f* together illustrate in cross section and perspective views, a magnetic element embodiment useful in magnetic tool apparatus in accordance with an aspect of the disclosure.

Figure 6A:
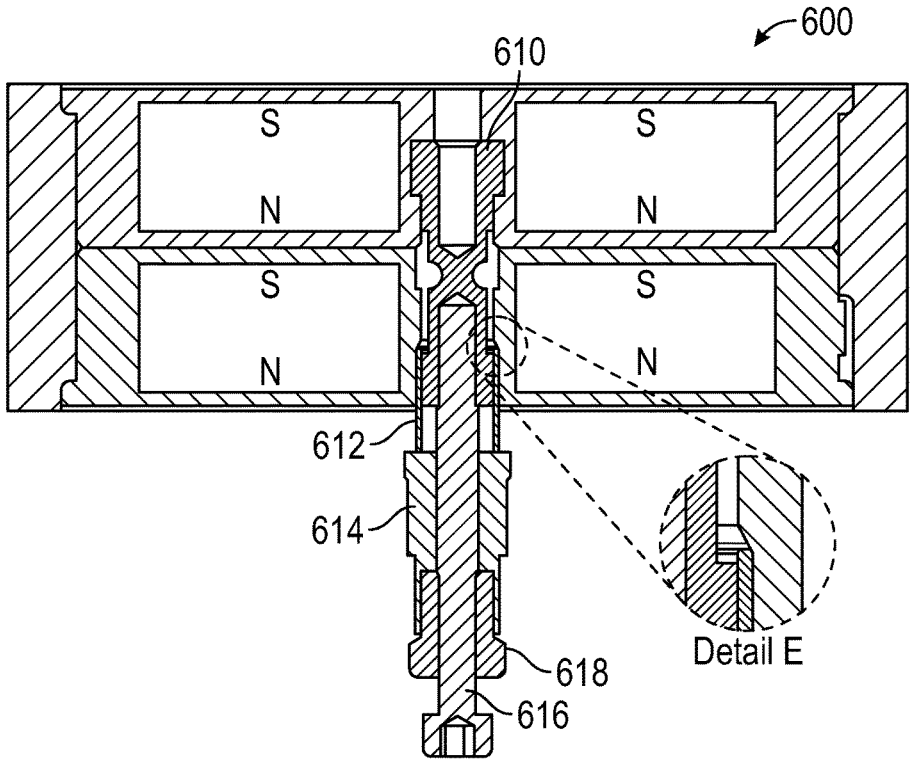
Figure 6B:
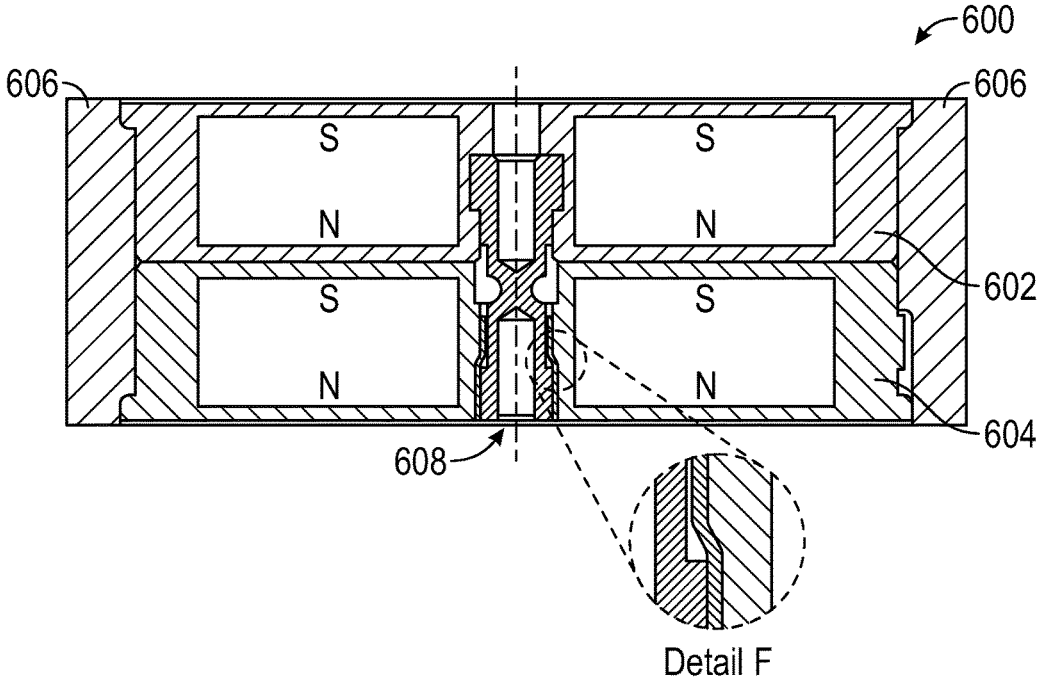
Figure 6C:
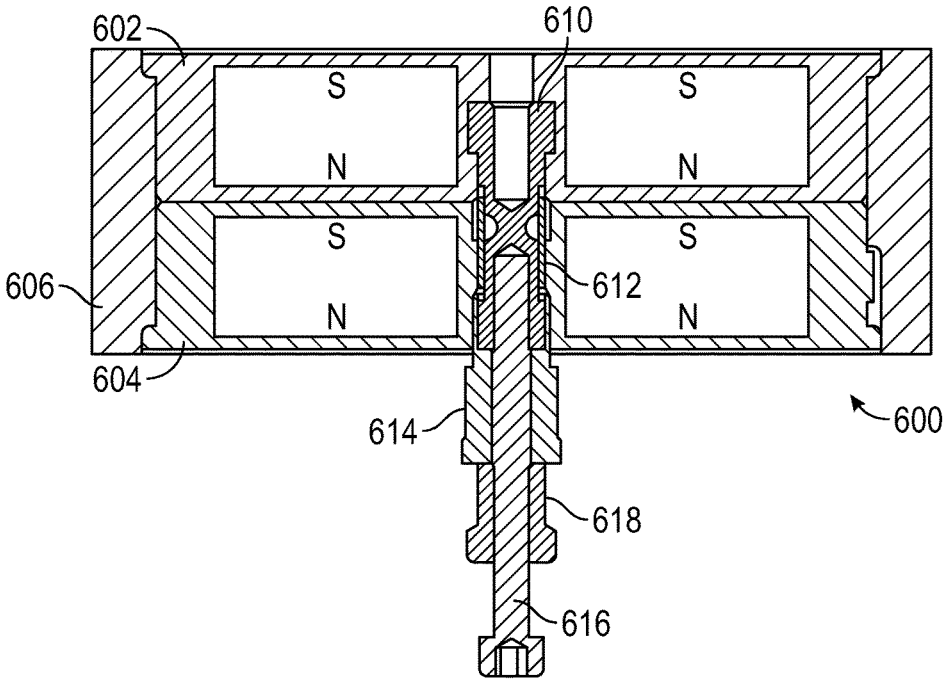

FIGS. 6*a*, 6*b* and 6*c* together illustrate yet another magnetic element embodiment useful with magnetic tool apparatus in accordance with an aspect of the disclosure.

Figure 7A:
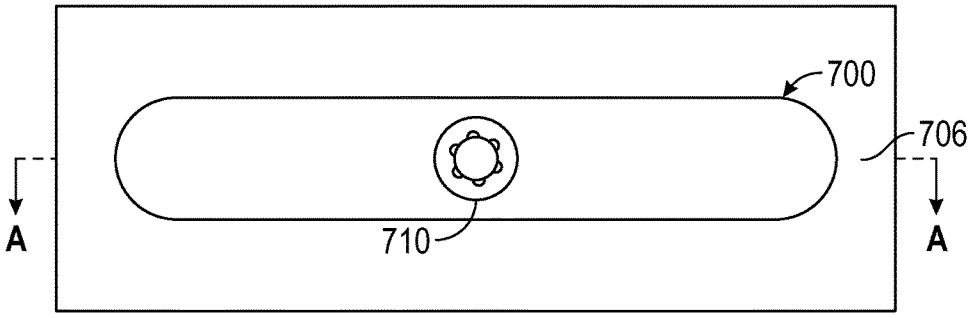
Figure 7B:
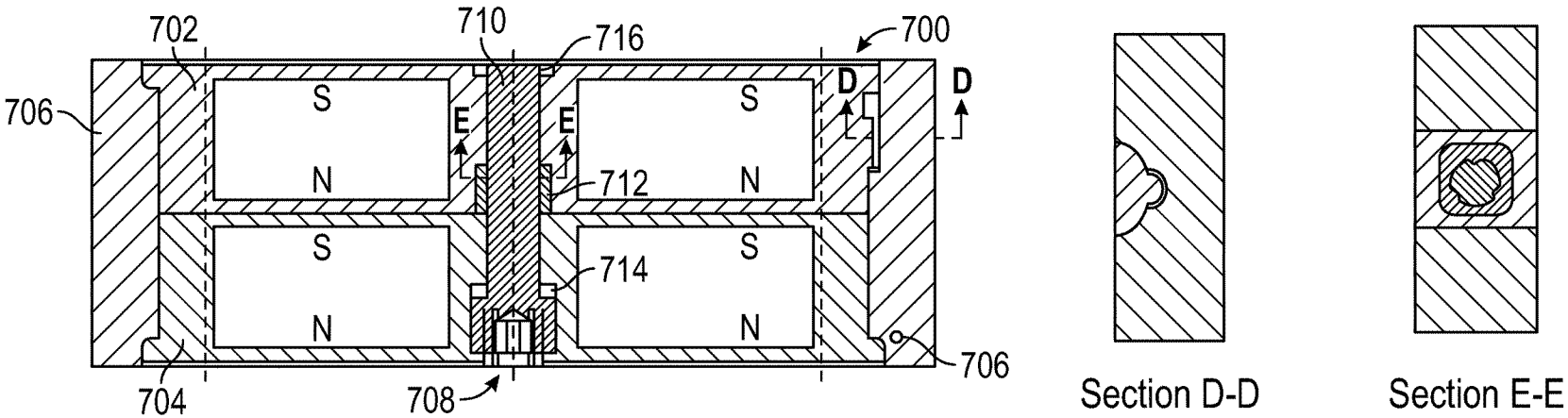
Figure 7C:
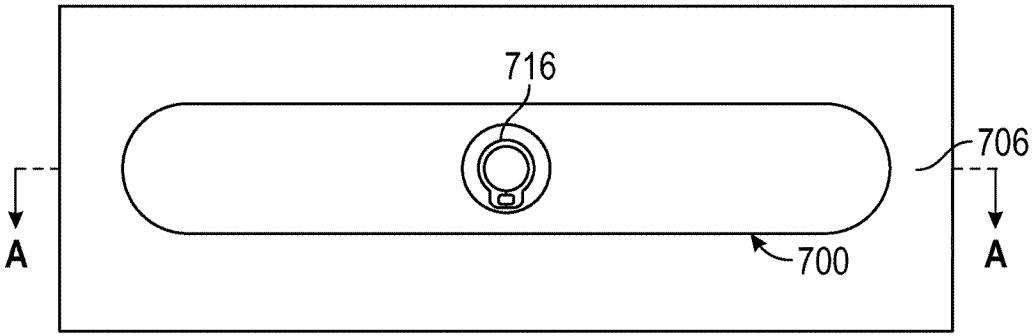

FIGS. 7*a*, 7*b* and 7*c* together illustrate in cross section views, yet another magnetic element embodiment useful in magnetic tool apparatus in accordance with an aspect of the disclosure.

Figure 8:
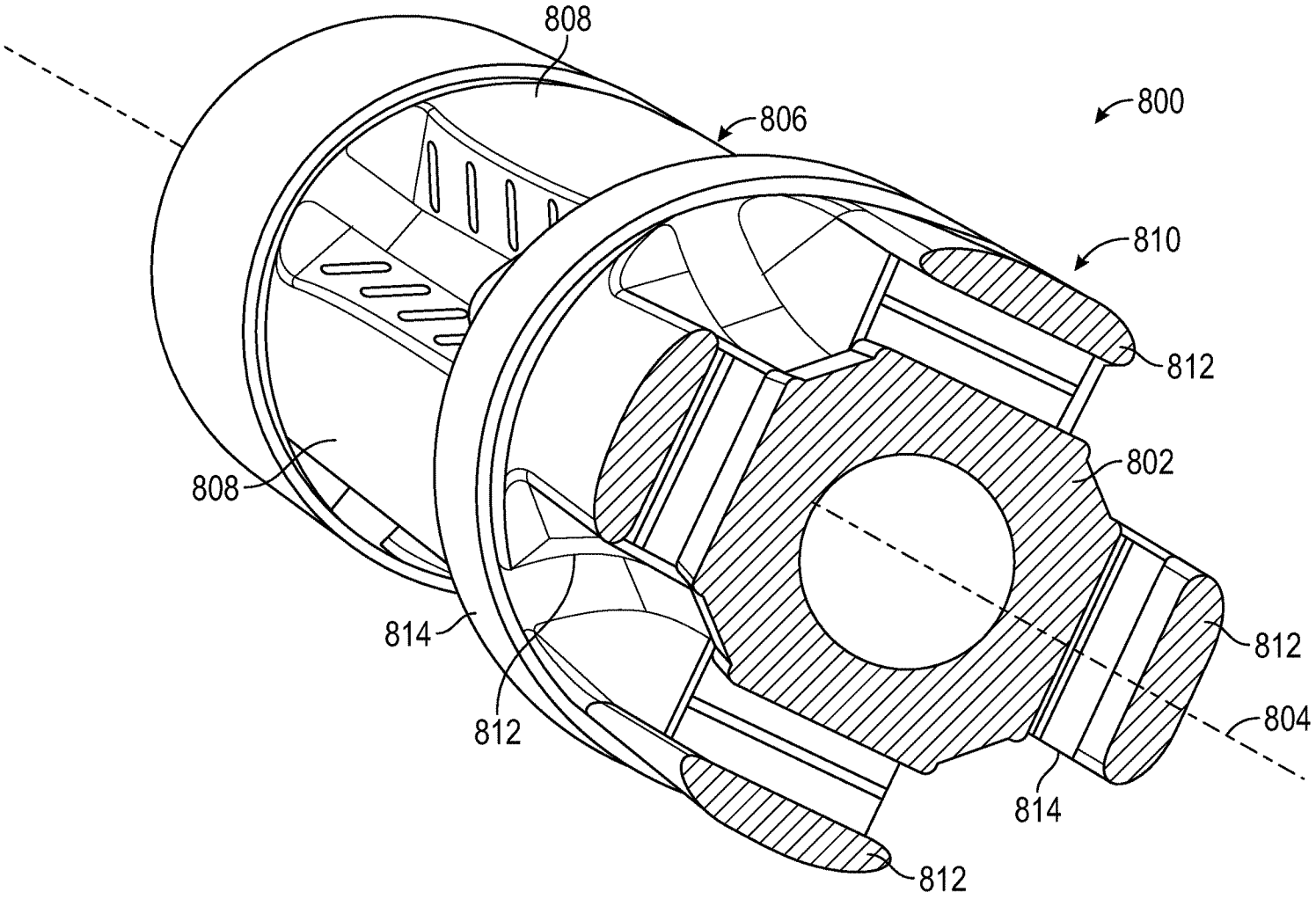

FIG. 8 is a perspective view of a portion of a magnetic tool apparatus in accordance with an aspect of the disclosure.

DETAILED DESCRIPTION

Example embodiments will now be described more fully with reference to the accompanying drawings. At the outset, it should be noted that in the development of any such actual embodiment, numerous implementation—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the apparatus used/disclosed herein can also comprise some components other than those cited.

Figure 1:
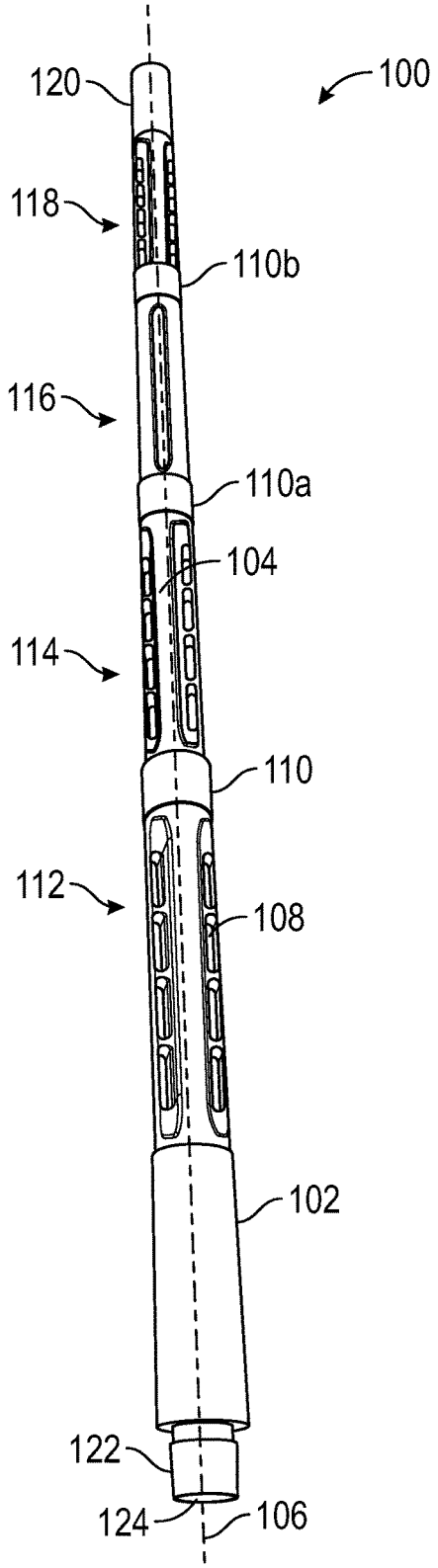
FIG. 1 is a perspective view of magnetic tool apparatus in accordance with an aspect of the disclosure.

In a first aspect, the disclosure relates to apparatus useful for removal of ferromagnetic metallic debris from an open-hole section of a wellbore. FIG. 1 depicts a magnetic tool apparatus according to one embodiment. Apparatus 100 generally includes an elongate tool body 102 which has one or more circumferentially arranged blades 104 (eleven shown) extending substantially perpendicular from the axial centerline 106 of the elongate tool body 102. Blades 104 may be configured with one or more slots 108 for receiving and securing one or more magnets. A hardfaced cylindrical section 110 may be disposed between a first bladed magnet section 112 and a second bladed magnet section 114. As illustrated in FIG. 1, a second hardfaced cylindrical section 110*a* and a third hardfaced cylindrical section 110*b* are disposed between and second bladed magnet section 114, third bladed magnet section 116, and fourth bladed magnet section 118. While the embodiment depicted in FIG. 1 shows three hardfaced cylindrical sections and four bladed magnet sections, any suitable number and orientation of hardfaced cylindrical sections and bladed magnet sections is within the scope and spirit of the disclosure.

Centralizers typically used with wellbore tools include a plurality of ribs orientated parallel with the axial centerline of the tool, and the periphery of the ribs define an effective diameter greater than the diameter of magnets or a carrier. Such ribs may prevent the carrier from engaging a sidewall of the well while the magnets retain collected debris on the outer surface of the tool. In contrast with a centralizer, the hardfaced cylindrical section may have a substantially smooth continuous circumferential surface, and not ribs. The smooth continuous circumferential surface of the hardfaced cylindrical section may provide benefits such as, but not limited to, stand off from the open-hole wellbore surface, reduction in differential sticking, and minimized damage to the surface of the open-hole wellbore, or uncased section of a wellbore.

In the embodiment illustrated in FIG. 1, tool body 102 includes an upper end 120 for threading, or otherwise connecting, the apparatus to a conventional workstring, and a lower end 122 for attaching a continuation of the workstring or another tool to the lower end of the tool body 102. A central bore 124 may be provided through the tool body 102, to pass fluid from the workstring through the tool body for drilling and/or washing the well, which may contribute to an upward flow of debris for aiding in the collection of debris on the magnets.

Figure 2:
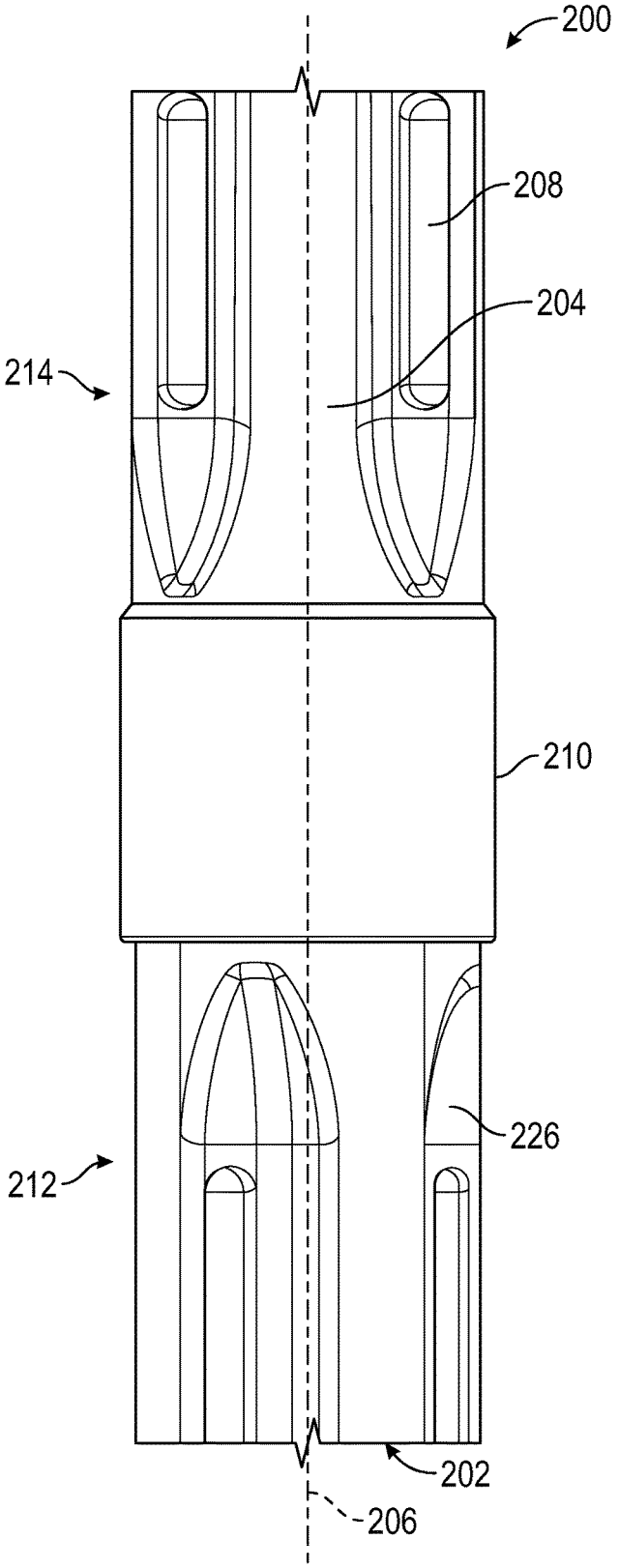
FIG. 2 is a perspective view of a portion of a magnetic tool apparatus in accordance with another aspect of the disclosure.

Now referring to FIG. 2, which depicts a portion 200 of an apparatus useful for removal of ferromagnetic metallic debris from an open-hole wellbore. Portion 200 includes circumferentially arranged blades 204 (six shown) extending substantially perpendicular from the axial centerline 206 of the tool body 202, and the blades 204 include slots 208 for accommodating magnets. The plurality of blades 204 define magnet pocket areas 226 (four shown) therebetween. A hardfaced cylindrical section 210 is disposed between bladed magnet section 212 and bladed magnet section 214. The hardfaced cylindrical section 210 defines the outer circumference of the tool body 202, and may be useful for protecting the blades from wear, providing a standoff from the open-hole wall to prevent packing of the magnet pocket areas 226 with balling material, providing standoff from the open-hole wall to prevent removal of magnetically attracted debris from magnet area, and/or reducing the effects of differential sticking. The hardfacing of the tool body 202 may be achieved by any metalworking process known in the art where harder or tougher material is applied to a base metal. For example, a hardface may be welded to the base material, and generally take the form of specialized electrodes for arc welding or filler rod for oxyacetylene and TIG welding. In some other cases, powdered metal alloys may be used in powder plasma welding system, or even thermal spray processes like HVOF, plasma spray, fuse and spray, and the like.

Referring again to FIG. 2, the plurality of magnet pocket areas 226 may be orientated at various angles relative to the overall circumference of the tool body to provide greater circumferential coverage, and in some embodiments, 360 degree circumferential coverage, as is illustrated further in FIGS. 3*a*, 3*b* and 3*c*, and described below. Magnet pocket areas 226 may also be orientated at least substantially parallel relative to axial centerline 206 in some aspects, while in some other aspects, the magnet pocket areas 226 may be orientated in a spiraling configuration, or other non-parallel orientation relative to axial centerline 206.

Now referencing FIGS. 3*a*, 3*b* and 3*c*, which together illustrate improved circumferential coverage of a plurality of magnet pocket areas. Each of FIGS. 3*a*, 3*b* and 3*c* depict cross-sectional bladed magnet sections 304, 306 and 308, with the cross-section made perpendicular to tool body axial centerline 206. For each bladed magnet sections four blades are shown extending substantially perpendicular from axial centerline 206, and the blades define four magnet pocket areas per bladed magnet section. 314, 316 and 318 depict some of the magnet pocket areas for bladed magnet sections 304, 306 and 308, and twelve magnet pocket areas in total are shown in FIGS. 3*a*, 3*b* and 3*c*. Magnet pocket areas have openings disposed upon, or parallel with, the circumference of the tool body. Each opening of the magnet pocket areas will span a number of degrees of the overall circumference of the tool body, as depicted by arrows 324, 326 and 328. The number of degrees spanned by a combination of magnet pocket area openings can be any suitable value, depending upon the desired tool design. In some aspects, the combined magnet pocket area openings may essentially span 360 degrees of the tool body circumference. Further, magnet pocket area openings may all be substantially equal in the number of degrees spanned, or in some other aspects, the number of degrees spanned by each opening may vary or otherwise be inconsistent. FIGS. 3*a*, 3*b* and 3*c* depict magnet pocket area openings which are substantially equal to one another.

In some embodiments, the magnet pocket area openings may be set at various angles relative one another to achieve target coverage of the circumference of the tool body. As shown in FIG. 3*b*, bladed magnet section 306 has four magnet pocket area openings, the center of each at an angle of zero degrees, 90 degrees, 180 degrees and 270 degrees, respectively, relative to centerline 302. Bladed magnet section 304 in FIG. 3*a* has magnet pocket area openings set at an angle of $\alpha$ relative to the four magnet pocket area openings of bladed magnet section 306. For example, if angle $\alpha$ is 30 degrees, then the center of each magnet pocket area opening of bladed magnet section 304 would be 30 degrees, 120 degrees, 210 degrees and 300 degrees, respectively, relative to centerline 302. Further, bladed magnet section 308 in FIG. 3*c* has magnet pocket area openings set at an angle of $\beta$ relative to the four magnet pocket area openings of bladed magnet section 306, and if angle $\beta$ is −30 degrees, then the center of each magnet pocket area opening of bladed magnet section 308 would be 60 degrees, 150 degrees, 240 degrees and 330 degrees, respectively, relative to centerline 302. In such way, as bladed magnet sections 304, 306 and 308 are orientated adjacent one another, substantial, if not complete, circumferential coverage of tool body with the combined magnet pocket area openings may be achieved. While three bladed magnet sections are shown collectively in FIGS. 3*a*, 3*b* and 3*c*, it is within the spirit and scope of the disclosure to use any suitable number bladed magnet sections.

Referring now to FIG. 4*a*, the detail of a magnetic tool apparatus 400 is shown, wherein, each blade 402 of a bladed magnet section extends substantially perpendicular from the axial centerline 404 of apparatus 400, and each blade 402 meets a recessed surface 406 adjacent the root or base 408 of the blade 402. At the radially outermost periphery, each blade 402 has a surface 410 with edges 412 on either side. Each blade merges with a hardfaced cylindrical section or a tool body at each end. The blades each have a series of elongate slots 416 (four in this embodiment but more or less may be used, and differing blades, e.g. shorter or longer, may have a different number of slots in other situations). Further detail of some suitable slots 416 is shown in FIG. 4*b*, which shows an enlarged perspective view from above and to one side of a slotted blade 402. The slot 416 has contoured edges with chamfered semi-circular edges 418 at either end of the slot, and the slot 416 lies between blade spokes 420. In some aspects, the edges of slots 416 may be flanged such that an outer surface, or both outer surfaces of a magnet seated within slot 416, is, or are flush with the surface of blade 402. As such, the edges of slots 416 may be flanged on one or both sides of blade 402. Slot 416 is shaped thus to receive a magnetic element and fastener assembly, for example, but not limited to, those illustrated herein below.

Referring to FIG. 4*c*, which depicts slots 416 which are chamfer flanged on both sides (see 418 and 428) of blade 402. The edges of slots 416 may be flanged on one or both sides of blade 402. When flanged on both sides, such an opposing double flange arrangement may be effective to protect a magnet fastener or magnet retainer from being loaded by conditions subjected to the apparatus in operation, such as pack-off induced stresses, hole collapse forces, and the like, which can occur in the open hole. In this arrangement, the fastener or retainer system may be protected while preventing the magnet(s) from becoming loose or free when subject to shock vibration, and the fastener or retainer system is not overly loaded, if loaded at all, when outer facing surfaces of the magnet(s) are loaded and further forced against the flange. In some cases, although the flange protects the fastener or retainer system under shock and vibration, it may protect when force is applied from one direction, and when a force load is applied in the reverse direction, the flange may become unloaded and the fastener or retainer system loaded in tension. While the particular slots illustrated above show particular features, any suitable slot design is with the scope of the disclosure.

Figure 5A:
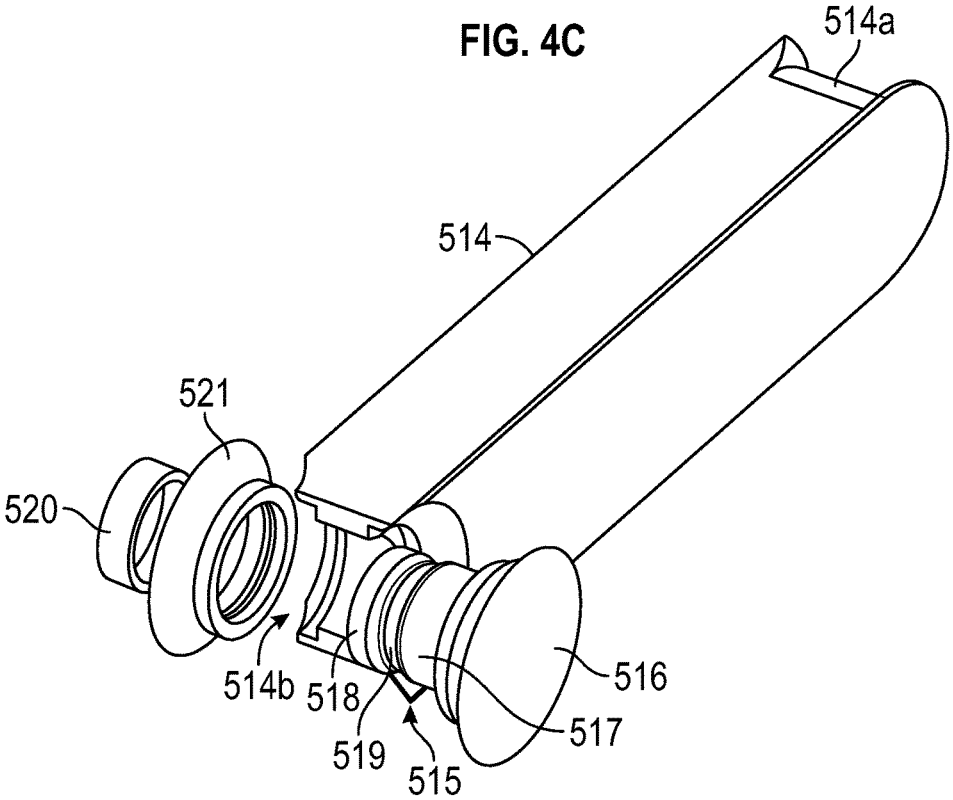
Figure 5B:
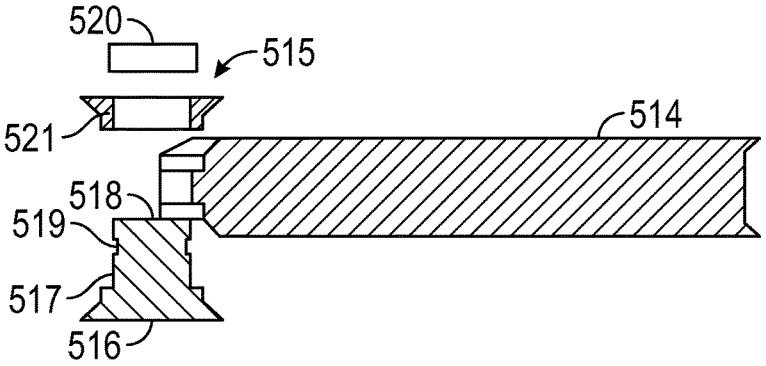

Referring now to FIG. 5*a*, one magnetic element embodiment 514 is depicted, which includes an elongate shaped casing adapted to seat in a slot (such as that shown in FIG. 4*b*) and having curved ends. In this embodiment, one curved end 514*a* is configured to seat closely into an end of a slot (such as 416 in FIG. 4*b*), and the other end 514*b* is recessed to accommodate a fastener assembly 515. Referring to FIG. 5*b*, the fastener assembly 515, comprises a fastener member having a head 516, a shank 517 with a configured end 518 and a deformable fastener ring 520 adapted to fit closely over the shank, and a collar 521 adapted to deform the deformable ring upon the configured end of the shank when assembled. Conveniently the deformation involves compression of the ring into one (or more) groove(s) 519 in the configured end 518 of the shank 517. This assembly allows a swaging technique to be used to fasten the magnetic element 514 within the blade and thereby securely mount the magnetic elements to the tool body. Thus the fastener assembly may include a retention pin (fastener member-516, 517, 518, 519), a swage ring (deformable fastener ring 520), and a swage cup (collar 521).

Figure 5C:
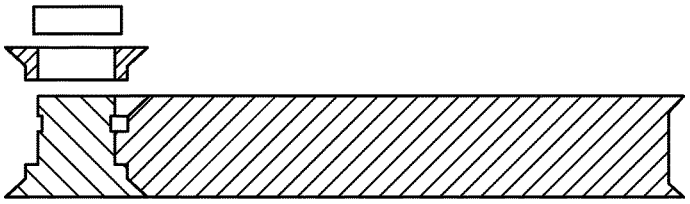
Figure 5D:
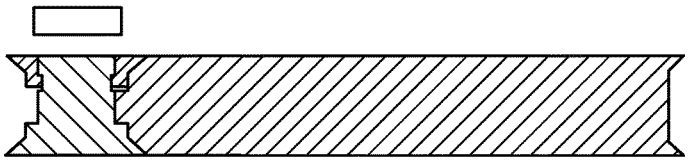
Figure 5E:
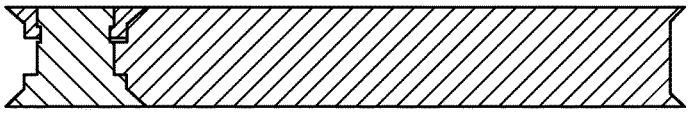
Figure 5F:
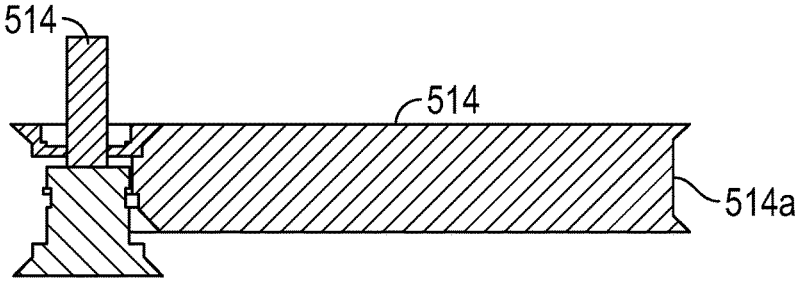

The respective head 516 and collar 521 of the fastener assembly are flanged to permit an interference fit with a corresponding part of the tool body to allow the fastener assembly to retain the magnetic element 514 in position upon the body. The flange is beveled to abut a corresponding chamfered seat in a contact surface within the tool body as well as allowing flush-fitting of the fastener assembly into the magnetic element which is valuable in avoiding fluid flow disturbance. FIGS. 5*c* through 5*e* show the steps of assembling, in one aspect, a magnetic element and fastener assembly as shown in FIGS. 5*a* and 5*b*. If it is desired to disassemble the tool to remove damaged magnetic elements 514, for example, then the deformed ring can be sheared and removed by applying a driving tool 542 to that end of the shank of the fastener member, to which the ring is fitted, and applying sufficient axial force along the shank whereby the shank is driven out of the slot as the ring is sheared as illustrated schematically in FIG. 5*f*. Re-assembly simply requires provision of a new deformable ring FIGS. 6*a*, 6*b* and 6*c* illustrate another magnetic element embodiment useful with magnetic tool apparatus according to the disclosure, in installation, installed and removal configurations, respectively. Magnetic element 600 includes first magnet 602 and second magnet 604. Magnets 602 604 are retained within a bladed magnet section slot (such as 416 in FIGS. 4*a* and 4*b*) of a blade, and secured therein by retainer system 608. Magnetic element 600 may also include an elongate shaped casing adapted to be disposed in the slot. When installed and secured in the slot by retainer system 608, magnets 602 604 are coupled together, have a magnetic attraction with one another to further secure them together under conditions of shock/vibration which would tend to load the retainer system, and outer surfaces of magnetic element 600 press-fit against spokes 606 of the blade (such as blade spokes 420 depicted in FIG. 4*b*). When magnets 602 604 are disposed in a slot with an opposing double flange arrangement, for example that illustrated in FIG. 4*c*, the retainer system may be protected while preventing the magnets from becoming loose or free when subject to shock vibration. As depicted in FIG. 6*c*, retainer system 608 includes retainer pin 610 and swage ring 612. Referencing FIG. 6*b*, in an installed configuration, swage ring 612 is disposed about the periphery of retainer pin 610, and applies outward pressure to press-fit magnetic element 600 against blade spokes 606. Swage ring 612 is disposed within magnetic element 600, as shown in Detail F and FIG. 6*b*.

Referring to FIG. 6*a*, installation of swage ring 612, to secure magnetic element 600 within a slot, may be achieved using installation tool 614, socket head cap screw 616 and installation nut 618. Swage ring 612 is partially inserted into an opening of magnetic element 600 as depicted in Detail E, and placed around the periphery of retainer pin 610. Installation tool 614 is placed adjacent a distal end of swage ring 612, and secured in place with socket head cap screw 616 and installation nut 618. Socket head cap screw 616 is threaded into retainer pin 610, and installation nut 618 is twisted and moved toward magnetic element 600 to thus move the installation tool 614 and swage ring 612 into magnetic element 600. When installed, the distal end of swage ring 612 may be substantially flush with an outer surface of magnetic element 600.

Now referring to FIG. 6*c*, removal of magnetic element 600 magnets 602 604 from a slot may be accomplished by dislodging swage ring 612 from a press-fit position. This may be achieved with swage ring installation tool 614, socket head cap screw 616 and installation nut 618. Installation tool 614 is placed adjacent the flush distal end of swage ring 612, and secured in place with socket head cap screw 616 and installation nut 618. Socket head cap screw 616 is threaded into retainer pin 610, and installation nut 618 is twisted and moved toward magnetic element 600 to thus move the tool 614 and swage ring 612 further into magnetic element 600. When dislodged from a press-fit position, the distal end of swage ring 612 may be positioned further within magnetic element 600. Magnets 602 604 may then be removed from the slot.

FIGS. 7*a*, 7*b* and 7*c* illustrate yet another magnetic element embodiment useful with magnetic tool apparatus according to the disclosure. As illustrated in FIG. 7*b*, magnetic element 700 includes first magnet 702 and second magnet 704. Magnets 702 704 are retained within a bladed magnet section slot (such as 416 in FIGS. 4*a* and 4*b*) and secured therein by retainer system 708. Magnetic element 700 also may include an elongate shaped casing adapted to seat in the slot. When installed and secured in the slot by retainer system 708, magnets 702 704 are coupled having a magnetic attraction with one another to further secure them together under conditions of shock/vibration which would tend to load a retainer system, and outer surfaces of magnetic element 700 press-fit against blade 706. When magnets 702 704 are disposed in a slot with an opposing double flange arrangement, such as that illustrated in FIG. 4*c*, the retainer system may be protected while preventing the magnets from becoming loose or free when subject to shock vibration. Retainer system 708 includes retainer bolt 710, rotary detent 712 (a catch preventing back-off rotation while in operation), a lock washer (such as a nord-loc) 714, and circlip 716. The retainer system 708 is disposed within magnetic element 700 when securing magnets 702 704 in the slot. As illustrated in Section D-D, magnet 702 may include a raised feature for guiding and securing within blade 706, as well as ensuring that when the tool is assembled, the magnets are properly fitted within the blade so as to ensure that the clockwise direction of polarity of the magnets fitted is always the same. In some embodiments, the raised feature is only included on one magnet half and on one position inside the slot of the blade. Section E-E depicts in a cross-sectional view, the arrangement of retainer bolt 710 and detent 712 installed in magnet 702. FIG. 7*a* is a side view showing one side magnetic element 700 as installed and secured within the slot of blade 706, and FIG. 7*c* shows the opposing side.

Now referencing FIG. 8, which depicts a portion of a magnetic tool apparatus, such as tool 100 in FIG. 1, in a cross-sectional perspective view. The portion 800 of the tool includes a cylindrical tool main body 802 which defines an axial centerline 804. The main body 802 includes a first bladed magnet section 806 having blades 808 extending substantially perpendicular from the axial centerline at a first angle. Although two blades 808 are shown, bladed magnet section 806 includes four blades. Main body 802 further includes a second bladed magnet section 810 having four blades 812 extending substantially perpendicular from the axial centerline 804 at a second angle. Each of blades 808 and 812 include slots for receiving and securing magnets therein, and in some embodiments, each blade contains four such slots. While four slots are contained in each blade according to this embodiment, more or less slots may be used, in accordance with the disclosure. Main body 802 also includes a hardfaced cylindrical section 814 disposed between the first bladed magnet section 806 and the second bladed magnet section 810. The outer circumference of the hardfaced cylindrical section 814 defines the outer circumference of the tool main body 802.

In another aspect, first bladed magnet section 806 defines a first circumference, and second bladed magnet section 810 defines a second circumference. Hardfaced cylindrical section 814 defines a third circumference, and the hardfaced cylindrical section 814 disposed between the first bladed magnet section 806 and the second bladed magnet section 810. The third circumference may be greater than or equal to the first circumference and the second circumference.

Optional modifications to the illustrated embodiment include provision of elements that are adapted to be inserted in the recess normally intended to receive magnets, but are in fact merely blanking or magnetic shielding elements. In such an embodiment one or more selected channels between radially extending blades serve, not only as ferrous debris catchment areas, but as fluid flow past channels. Such selected flow past channels may offer advantages if there is a need to retrieve the tool quickly during a POOH run or use in a hole where flow restriction may be anticipated to be problematic.

The outer diameter of magnetic tool apparatus according to the disclosure may be any suitable diameter effective for running into a wellbore and removing ferrous metal debris from an open-hole section of the wellbore. In some embodiments, the outer diameter of the tool is 6.75 inches, which may be effective with an 8.5 inch diameter bottom-hole assembly. Other non-limiting examples of outer diameters include about 4 inches, about 6 inches, about 8 inches, about 12 inches, about 18 inches, about 24 inches, about 30 inches, and the like.

In a typical use of the magnetic tool apparatus, the tool is provided as part of a string run into the wellbore and may, for example, form part of a drilling or milling string (not shown) which may for example include jetting, milling or other tool functions.

According to some method embodiments of the disclosure, methods of retrieving ferrous metal debris from a well include attaching to a work string, an apparatus comprising a first bladed magnet section, a second bladed magnet section and a hardfaced cylindrical section disposed between the first bladed magnet section and the second bladed magnet section. The apparatus is run into an open-hole section of a wellbore to attract and retain ferrous metal debris in any of the first bladed magnet and the second bladed magnet sections. The apparatus is then removed from the wellbore in order to remove the ferrous metal debris.

The foregoing description of the embodiments has been provided for purposes of illustration and description. Example embodiments are provided so that this disclosure will be thorough, and will fully convey the scope to those who are skilled in the art. Numerous specific details are set forth such as examples of specific components, devices, and methods, to provide a thorough understanding of embodiments of the disclosure, but are not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although various embodiments have been described with respect to enabling disclosures, it is to be understood the invention is not limited to the disclosed embodiments. Variations and modifications that would occur to one of skill in the art upon reading the specification are also within the scope of the invention, which is defined in the appended claims.

The following is claimed:

1. An apparatus comprising:

a cylindrical tool main body defining an axial centerline, the cylindrical tool main body comprising:

a first bladed magnet section having at least one first blade extending outwardly from the axial centerline at a first angle;

a second bladed magnet section having at least one second blade extending outwardly from the axial centerline at a second angle;

a hardfaced cylindrical section extending from the first bladed magnet section to the second bladed magnet section, wherein an outer circumference of the hardfaced cylindrical section defines an outermost circumference of the cylindrical tool main body, and further wherein the hardfaced cylindrical section has a smooth continuous circumferential surface extending from the first bladed magnet section to the second bladed magnet section and is free of ribs; and an upper end configured for suspending the cylindrical tool main body, wherein the first bladed magnet section and the second bladed magnet section each comprise slots therein for receiving and securing magnets, and wherein at least one slot of the slots comprises:

opposing flanges:

at least two magnets disposed within the at least one slot and magnetically coupled to one another such that a north pole of one magnet of the at least two magnets is in direct physical contact with a south pole of another magnet of the at least two magnets; and a retainer system for securing the at least two magnets, such that the at least two magnets are in direct physical contact with one another.

2. The apparatus of claim 1, further comprising:

a third bladed magnet section having at least one third blade extending outwardly from the axial centerline at a third angle; and a second hardfaced cylindrical section disposed between the second bladed magnet section and the third bladed magnet section.

3. The apparatus of claim 2, further comprising:

a fourth bladed magnet section having at least one fourth blade extending outwardly from the axial centerline at a fourth angle; and a third hardfaced cylindrical section disposed between the third bladed magnet section and the fourth bladed magnet section.

4. The apparatus of claim 3, wherein the first bladed magnet section, the second bladed magnet section, the third bladed magnet section, and the fourth bladed magnet section each comprise four blades extending outwardly from the axial centerline.

5. The apparatus of claim 3, wherein a plurality of magnet pocket area openings is defined between the at least one first blade, the at least one second blade, and the at least one third blade, and the plurality of magnet pocket area openings span 360 degrees of an overall circumference of the cylindrical tool main body.

6. The apparatus of claim 1, wherein the first bladed magnet section and the second bladed magnet section each comprise our slots.

7. The apparatus of claim 1, further comprising:

a third bladed magnet section having at least one third blade extending outwardly from the axial centerline at a third angle; and a second hardfaced cylindrical section extending from the second bladed magnet section to the third bladed magnet section, wherein an outer surface of the at least one second blade extends from the hardfaced cylindrical section to the second hardfaced cylindrical section and is radially spaced from the axial centerline a constant distance.

8. A cleaning tool for use in cleaning ferrous material from an open-hole wellbore, the cleaning tool comprising:

a first bladed magnet section defining a first circumference;

a second bladed magnet section defining a second circumference; and a hardfaced cylindrical section defining a third circumference, the hardfaced cylindrical section extending from the first bladed magnet section to the second bladed magnet section, wherein the third circumference is greater than the first circumference and the second circumference, further wherein the hardfaced cylindrical section has a smooth continuous circumferential surface extending from the first bladed magnet section to the second bladed magnet section and is free of ribs, wherein the first bladed magnet section and the second bladed magnet section each comprise slots therein for receiving and securing magnets, and wherein at least one slot of the slots comprises:

opposing flanges;

at least two magnets disposed within the at least one slot and magnetically coupled to one another such that a north pole of one magnet of the at least two magnets is in direct physical contact with a south pole of another magnet of the at least two magnets; and a retainer system for securing at least two magnets, such that the at least two magnets are in direct physical contact with one another.

9. The cleaning tool of claim 8, further comprising:

a third bladed magnet section defining a fourth circumference; and a second hardfaced cylindrical section disposed between the second bladed magnet section and the third bladed magnet section, wherein the third circumference is greater than the fourth circumference.

10. The cleaning tool of claim 9, further comprising:

a fourth bladed magnet section defining a fifth circumference; and a third hardfaced cylindrical section disposed between the third bladed magnet section and the fourth bladed magnet section, wherein the third circumference is greater than the fifth circumference.

11. The cleaning tool of claim 10, wherein the first bladed magnet section, the second bladed magnet section, the third bladed magnet section, and the fourth bladed magnet section each comprise four blades extending outwardly from an axial centerline of the cleaning tool.

12. The cleaning tool of claim 11, wherein a plurality of magnet pocket area openings is defined between the four blades of the first bladed magnet section, the second bladed magnet section, the third bladed magnet section, and the fourth bladed magnet section, and the plurality of magnet pocket area openings span 360 degrees of an overall circumference of the cleaning tool.

13. The cleaning tool of claim 8, wherein the first bladed magnet section and the second bladed magnet section each comprise four slots.

14. A cleaning tool for use in cleaning ferrous material from an open-hole wellbore, the cleaning tool comprising:

a first bladed magnet section defining a first circumference;

a second bladed magnet section defining a third circumference; and at least one hardfaced cylindrical section defining a second circumference, the hardfaced cylindrical section extending from the first bladed magnet section to the second bladed magnet section, wherein the first bladed magnet section comprises at least one slot having:

opposing flanges;

at least two magnets disposed within the at least one slot and magnetically coupled to one another such that a north pole of one of the at least two magnets is in direct physical contact with a south pole of another magnet of the at least two magnets; and a retainer system for securing the at least two magnets, such that the at least two magnets are in direct physical contact with one another, and further wherein the first circumference and the third circumference are less than the second circumference, and the at least one hardfaced cylindrical section has a smooth continuous circumferential surface extending from the first bladed magnet section to the second bladed magnet section and is free of ribs.

15. The cleaning tool of claim 14, further comprising:

a third bladed magnet section defining a fourth circumference; and a second hardfaced cylindrical section disposed between the second bladed magnet section and the third bladed magnet section, wherein the second circumference is greater than the fourth circumference.

16. The cleaning tool of claim 15, further comprising:

a fourth bladed magnet section defining a fifth circumference; and a third hardfaced cylindrical section disposed between the third bladed magnet section and the fourth bladed magnet section, wherein the second circumference is greater than the fifth circumference.

17. The cleaning tool of claim 14, wherein the retainer system comprises one or more of a bolt, a rotary detent, a lock washer, and a circlip.

18. The cleaning tool of claim 14, wherein the retainer system comprises a retainer pin and a swage ring.

19. The cleaning tool of claim 18, wherein the swage ring is installable with a swage ring installation tool, a socket head cap screw, and an installation nut.

20. The cleaning tool of claim 14, wherein the at least one magnet further comprises a raised feature.

21. A method of retrieving ferrous metal debris from a well, the method comprising:

attaching an apparatus to a work string, the apparatus comprising a first bladed magnet section;

a second bladed magnet section; and a hardfaced cylindrical section extending from the first bladed magnet section to the second bladed magnet section, wherein an outer circumference of the hardfaced cylindrical section defines an outermost circumference of the apparatus, and the hardfaced cylindrical section has a smooth continuous circumferential surface extending from the first bladed magnet section to the second bladed magnet section and is free of ribs, wherein the outer circumference of the hardfaced cylindrical section is greater than a circumference of the first bladed magnet section and a circumference of the second bladed magnet section, wherein the first bladed magnet section and the second bladed magnet section each comprise slots therein for receiving and securing magnets, and wherein at least one slot of the slots comprises:

opposing flanges;

at least two magnets disposed within the at least one slot and magnetically coupled to one another such that a north pole of one magnet of the at least two magnets is in direct physical contact with a south pole of another magnet of the at least two magnets; and a retainer system for securing the at least two magnets, such that the at least two magnets are in direct physical contact with one another; running the apparatus into an open-hole section of a wellbore;

attracting and retaining ferrous metal debris in at least one of the first bladed magnet section and the second bladed magnet section; and removing the apparatus from the wellbore.

22. The method of claim 21, wherein the apparatus further comprises a third bladed magnet section, and a second hardfaced cylindrical section disposed between the second bladed magnet section and the third bladed magnet section.

23. The method of claim 22, wherein the apparatus further comprises a fourth bladed magnet section, and a third hardfaced cylindrical section disposed between the third bladed magnet section and the fourth bladed magnet section.

24. The method of claim 23, wherein the first bladed magnet section, the second bladed magnet section, the third bladed magnet section, and the fourth bladed magnet section each comprise four blades extending outwardly from an axial centerline of the apparatus.

25. The method of claim 24, wherein a plurality of magnet pocket area openings is defined between the four blades of the first bladed magnet section, the second bladed magnet section, the third bladed magnet section, and the fourth bladed magnet section, and the plurality of magnet pocket area openings span 360 degrees of an overall circumference of the apparatus.

26. The method of claim 21, wherein the first bladed magnet section and the second bladed magnet section each comprise four slots.

* * * * *